US007149274B2

(12) United States Patent
Tang

(10) Patent No.: US 7,149,274 B2
(45) Date of Patent: Dec. 12, 2006

(54) ADDRESSING TYPE COIN-DROPPING DETECTOR CIRCUIT

(75) Inventor: Di Tang, Taipei (TW)

(73) Assignee: Tatung Co., Ltd., Taipei (TW)

( * ) Notice: Subject to any disclaimer, the term of this patent is extended or adjusted under 35 U.S.C. 154(b) by 61 days.

(21) Appl. No.: 11/142,264

(22) Filed: Jun. 2, 2005

(65) Prior Publication Data

US 2005/0276368 A1 Dec. 15, 2005

(30) Foreign Application Priority Data

Jun. 15, 2004 (TW) ..... 93117164 A

(51) Int. Cl.
*G06M 7/00* (2006.01)
*G06M 9/00* (2006.01)

(52) U.S. Cl. ..... 377/7; 453/30; 453/58

(58) Field of Classification Search ..... None
See application file for complete search history.

(56) References Cited

U.S. PATENT DOCUMENTS 4,109,774 A * 8/1978 Hayashi ..... 194/215
4,369,442 A * 1/1983 Werth et al. ..... 377/7
4,432,447 A * 2/1984 Tanaka ..... 194/318
4,646,767 A * 3/1987 Hikita ..... 453/58

* cited by examiner

*Primary Examiner*—Tuan T. Lam
(74) *Attorney, Agent, or Firm*—Bacon & Thomas, PLLC

(57) ABSTRACT

The present invention relates to an addressing type coin-dropping detector circuit, in which as any coin dropping and passing through the photo detector, impulses are produced from the detecting points of the external photo detector and then sent to the addressing type coin-dropping detector circuit. Followed by the enumerations performed by the addressing type coin-dropping detector circuit, an impulse-length value is derived and transmitted to the external circuit through addressing mechanism, which increases overall integrated level of the circuit with a more efficient design in terms of memory and circuit utilization.

7 Claims, 2 Drawing Sheets

ADDRESSING TYPE COIN-DROPPING DETECTOR CIRCUIT

BACKGROUND OF THE INVENTION

1. Field of the Invention

The present invention relates to a coin-dropping detector circuit and, more particularly, to an addressing type coin-dropping detector circuit.

2. Description of Related Art

Central Processor Unit (CPU) is widely known for the integration of components, including a control unit, an arithmetic and logic unit, and a register, of which the control unit is responsible for coordinating and conducting data transmission and operation between units within a CPU, allowing the CPU to finish tasks that have been ordered; the arithmetic and logic unit consists of the algorithm unit and the logic unit that perform arithmetic operations (addition, subtraction, multiplication, and division) and logic operations (AND, OR, and NOT) respectively and output operation results performed by the above-mentioned arithmetic and logic unit thereof to the register. The arithmetic and logic unit comprises a frequency counter wherein as the CPU receives a clock from an external device, the frequency counter begins enumerating the clock and outputting a result to the CPU. Having utilized the CPU to set an address to the frequency counter will not only waste energy but also reduce efficiency overall.

Therefore, it is desirable to provide an improved addressing type coin-dropping detector circuit to mitigate and/or obviate the aforementioned deficiencies.

SUMMARY OF THE INVENTION

The present invention has been accomplished under the circumstances in view. It is therefore the main object of the present invention to provide an addressing type coin-dropping detector circuit, which takes advantages of addressing to control inputs and outputs of data. As a result, the space of the memory can be used effectively, and the cost for extra memories can be saved.

It is another object of the present invention to provide an addressing type coin-dropping detector circuit, which takes advantages of addressing to control inputs and outputs of the data in order to enhance the integration of the circuit.

To achieve this and other objects of the present invention, an addressing type coin-dropping detector circuit that assigns a hardware address to perform an addressing operation, by which the circuit receives an impulse inputted by an external photo detector and outputs an impulse-length value to an external circuit, comprises: a bus, a data acquisition controller, which is electrically connected to the bus, that receives address and data from the bus; a plurality of control pins used to control data transmission of the addressing type non-synchronized divider; an addressing type input register used to save the address and data inputted by the external circuit and outputs the same; a frequency divider for receiving local clocks to perform dividing frequency, a plurality of counters for receiving the impulse from the external photo detector, so as to perform an impulse counting to generate an impulse-length value; a signal detector used to receive the impulse-length value outputted from the counters thereof and output an enable signal to the external circuit, and an addressing type output register that is able to receive the impulse-length value inputted by the counters thereof and outputs to the external circuit.

The plurality of control pins comprise a ALE pin, a NWR pin, and a NRD pin, using to control data transmission of the bus.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
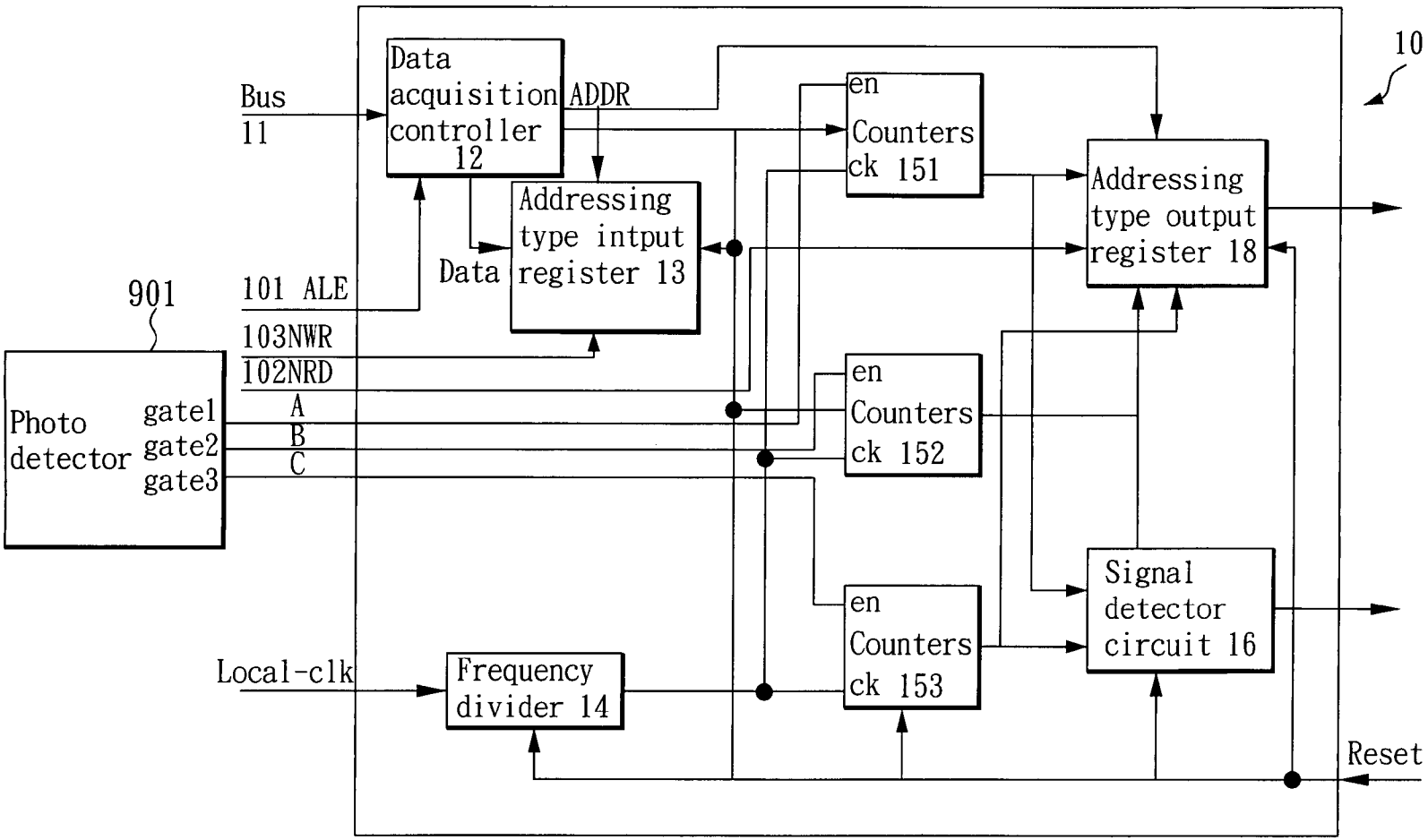
FIG. 1 is a functional diagram of this present invention.

FIG. 1 is a functional diagram illustrating this preferred embodiment, wherein the addressing type coin-dropping detector circuit 10 as shown comprises a bus 11, a data acquisition controller 12, an ALE pin 101, a NRD pin 102, a NWR pin 103, an addressing type input register 13, a frequency divider 14, a plurality of counters 151, 152, 153, a signal detector circuit 16, and an addressing type output register 18. In this embodiment, aforementioned bus 11 is a bus in general both used as an address bus and a data bus. The data acquisition controller 12, which is electrically connected to the bus 11, receives data and address from the bus 11. The ALE pin 101, the NRD pin 102, and the NWR pin 103 used to control data transmission of addressing type coin-dropping detector circuit 10. The addressing type input register 13 saves the input address and data from an external circuit. The frequency divider 14 receives the local clocks and divides frequency for outputting to the counters 151, 152, 153, in which the counters 151, 152, 153 receives the impulse from the external photo detector 901, so as to perform an impulse counting to generate an impulse-length value. As the signal detector circuit receives the impulse-length value inputted by the counters 151, 152, 153, the signal detector then outputs an enable signal to the external circuit. The addressing type output register 18, on the other hand, receives the impulse-length value inputted by the counters 151, 152, 153 and outputs the same through an addressing mechanism to the external circuit.

In this embodiment, the bus 11 uses a package containing address and data to perform the data transmission. The address of the package, which is used for determining whether the address of the package matches with the address of the control pins by comparing with the ALE pin 101, the NRD pin 102, and the NWR pin 103; if true, beginning performing data transmission.

In this embodiment, the user is able to set a hardware address of the addressing type coin-dropping detector circuit 10. When the addressing type coin-dropping detector circuit 10 receives an address signal from the external circuit, the addressing type coin-dropping detector circuit 10 will determine whether the hardware address of the address signal matches with the hardware address of the addressing type frequency counter circuit 10; if true, beginning receiving data from the bus 11.

Figure 2:
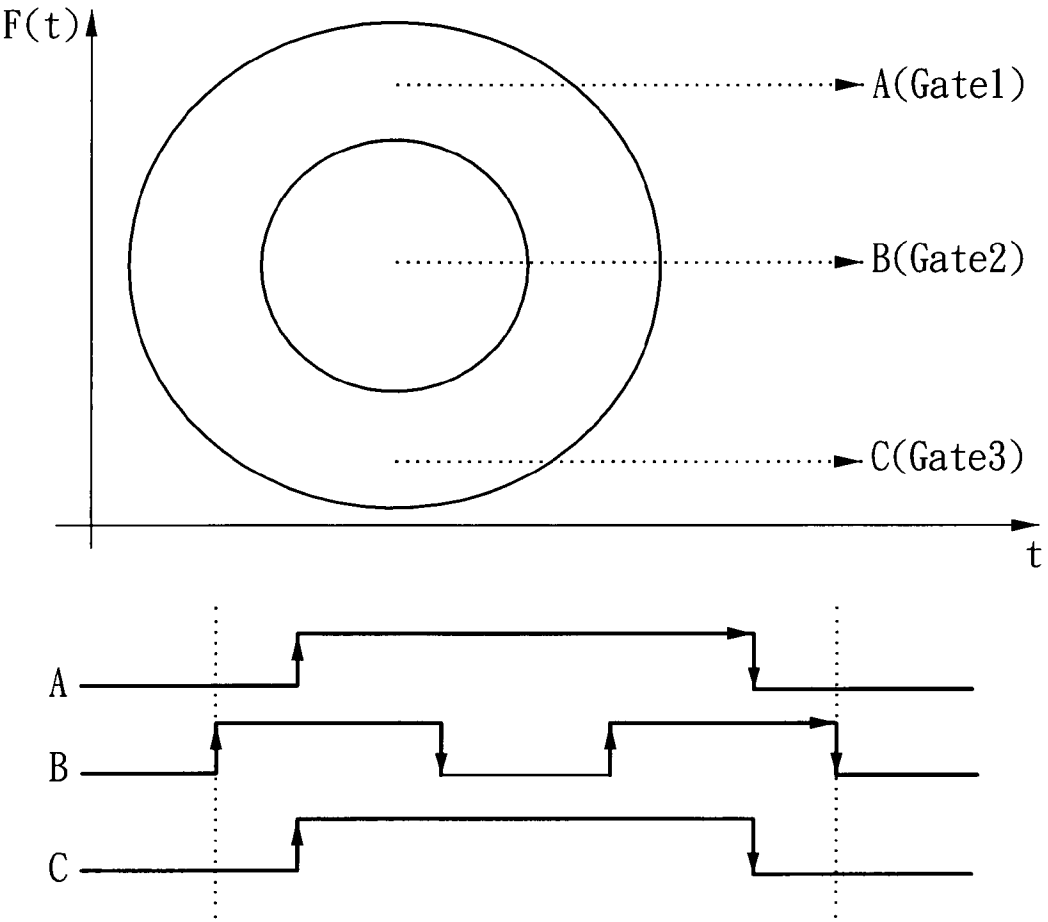
FIG. 2 is a representational diagram illustrating impulses produced at the detecting points according to the present invention.

With reference to FIG. 1, the addressing type coin-dropping detector circuit 10 must be reset prior to performing the addressing operation in order to ensure the accuracy of the data of the addressing type coin-dropping detector circuit 10. In this embodiment, when the external photo detector 901 detects any coin being dropped, as shown in FIG. 2 as coins passing through detecting points gate 1, gate 2, and gate 3 of the photo detector 901, the detecting points gate 1, gate 2, and gate 3 will produce impulses A, B, and C respectively from the masks of the dropped coins and transmit these impulses A, B, and C to the counters 151, 152, 153. The counters 151, 152, 153 proceed to an enable mode as they receive the impulses A, B, and C from the photo detector 901; the counters 151, 152, 153 will then utilize the local clock that has been processed by the frequency divider 14 to derive an impulse-length value from performing enumerations on the impulses A, B, and C. The impulse-length value will be transmitted to the signal detector circuit 16 and the addressing type output register 18. As the signal detector circuit 16 receives the impulse-length value from the counters 151, 152, 153, it will output an enable signal to the external circuit, informing that the addressing type coin-dropping detector circuit has now entered into an enable mode; meanwhile the addressing type output register 18 incorporated with the NRD pin 102 will send out the impulse-length value to the external circuit according to the address assigned.

Although the present invention has been explained in relation to its preferred embodiment, it is to be understood that many other possible modifications and variations can be made without departing from the scope of the invention as hereinafter claimed.

What is claimed is:

1. An addressing type coin-dropping detector circuit that assigns a hardware address to perform an addressing operation, by which the circuit receives an impulse inputted by an external photo detector and outputs an impulse-length value to an external circuit, comprising:

a bus;

a data acquisition controller electrically connected to the bus, for receiving address and data from the bus;

a plurality of control pins, used to control data transmission of the addressing type coin-dropping detector circuit;

an addressing type input register, used to save the address and data inputted by the external circuit;

a frequency divider circuit for receiving local clocks to perform dividing frequency;

a plurality of counters for receiving the impulse from the external photo detector, so as to perform an impulse counting to generate an impulse-length value;

a signal detector circuit, used to receive the impulse-length value outputted from the counters and output an enable signal to the external circuit; and an addressing type output register, used to receive the impulse-length value inputted by the counters and output to the external circuit.

2. The addressing type coin-dropping detector circuit as claimed in claim 1, wherein the plurality of control pins comprise an ALE pin.

3. The circuit as claimed in claim 1, wherein the plurality of control pins comprise a NWR pin.

4. The circuit as claimed in claim 1, wherein the plurality of control pins comprise a NRD pin.

5. The circuit as claimed in claim 2, wherein as the addressing type coin-dropping detector circuit uses the ALE pin to control data transmission of the bus, the data of the bus is an address.

6. The circuit as claimed in claim 3, wherein as the addressing type coin-dropping detector circuit use the NWR pin to control data transmission of the bus, the data of the bus is inputted to the addressing type coin-dropping detector circuit.

7. The circuit as claimed in claim 4, wherein as the addressing type coin-dropping detector circuit use the NRD pin to control data transmission of the bus, the data of the bus is outputted from the addressing type coin-dropping detector circuit.

* * * * *